US005821837A

United States Patent [19]

Accatino et al.

[11] Patent Number: 5,821,837

[45] Date of Patent: Oct. 13, 1998

[54] MULTI-MODE CAVITY FOR WAVEGUIDE FILTERS

[75] Inventors: Luciano Accatino, Rosia; Giorgio Bertin, Turin, both of Italy

[73] Assignee: Cselt- Centro Studi e Laboratori Telecomunicazioni S.p.A., Turin, Italy

[21] Appl. No.: 777,163

[22] Filed: Dec. 26, 1996

[30] Foreign Application Priority Data

Jan. 30, 1996 [IT] Italy ..... TO96A0057

[51] Int. Cl.[6] ..... H01P 1/208

[52] U.S. Cl. ..... 333/208; 333/212

[58] Field of Search ..... 333/202, 208–212, 333/227, 230

[56] References Cited

U.S. PATENT DOCUMENTS

| | | | |
|---|---|---|---|
| 3,235,822 | 2/1966 | De Loach | 333/212 |
| 4,513,264 | 4/1985 | Dorey | 333/212 |
| 4,630,009 | 12/1986 | Tang | 333/212 X |
| 4,734,665 | 3/1988 | Rosenberg et al. | 333/229 X |

FOREIGN PATENT DOCUMENTS

| | | | |
|---|---|---|---|
| 1050127 | 3/1979 | Canada | 333/212 |
| 0 687 027 | 12/1995 | European Pat. Off. . | |
| 4116755 | 1/1988 | Germany | 333/208 |
| 60-174501 | 9/1985 | Japan . | |

OTHER PUBLICATIONS

Kühn, "Microwave bandpass filters . . . with 1–dimensional offsets", Circuit theory & applications, vol. 6, No. 1, pp. 13–29, Jan. 1978.

*Primary Examiner*—Seungsook Ham
*Attorney, Agent, or Firm*—Herbert Dubno

[57] ABSTRACT

A multi-mode, typically triple-mode, cavity (1), for waveguide band-pass filters is disclosed, which cavity requires no tuning or coupling screws and rounded. The cavity comprises a waveguide element such as an iris (IR1) or a waveguide segment (CR2) arranged in a generically eccentric position with respect to the general development of the cavity and in particular to the main axis (Z) of the same. The cavity may be used to make narrowband filters for satellite communications. A filter comprising cavities (1) of the type described can be designed entirely using an electronic computer and requires no calibration procedure.

10 Claims, 2 Drawing Sheets

MULTI-MODE CAVITY FOR WAVEGUIDE FILTERS

SPECIFICATION

Our present invention relates to a multimode cavity for waveguide filters comprising a waveguide portion allowing for at least one resonant mode transverse with respect to a main axis of the cavity resonate.

BACKGROUND OF THE INVENTION

A dual-mode cavity with such characteristics is described, for example, in commonly owned EP-A-0 687 027 (U.S. Pat. No. 5,703,547 filed 30 Dec. 1997). That previous document can usefully serve as a reference to illustrate the general problems inherent in manufacturing such cavities, particularly with regard to the possibility of making waveguide filters suitable for being completely designed by computer aided design techniques, with no need for specific calibration operations like the ones required by conventional cavities fitted with tuning and coupling screws.

In particular, the solution described in EP-A-0 687 027 (U.S. Pat. No. 5,703,547) comprises three coaxial waveguide segments arranged in cascade along the main axis of the cavity. The two end segments (with circular, square or rectangular cross section) allow for two modes to resonate, which modes have linear polarization parallel and respectively perpendicular to a reference plane essentially identified by the diameter plane parallel to the major dimension of the iris used to couple the modes into the cavity. The intermediate segment consists of a waveguide with rectangular cross section whose sides are inclined by a given angle with respect to the aforesaid reference plane.

U.S. Pat. No. 3,235,822 (De Loach) and U.S. Pat. No. 4,513,264 (Dorey et al.) disclose filters comprising a plurality of cavities each made by a single rectangular waveguide segment, where the waveguide segments may be inclined with respect to one another.

In U.S. Pat. No. 3,235,822 inclination is used to vary the amount of coupling between two adjacent cavities between a maximum and a minimum value. The cavities are strictly single-mode cavities. Increasing the shorter dimension of the rectangular cross section so as to give a nearly-square cross section (as would be required for dual-mode operation) would result in a loss of control over the transmission characteristics of the filter, making it impossible to obtain useful electrical responses from the filter. Moreover, for very narrow bandwidths, such as the ones the present invention is concerned with, tuning screws are required.

In U.S. Pat. No. 4,513,264 inclination of the second cavity with respect to the first one is used to generate diagonal couplings between adjacent cavities. Coupling between the two modes and tuning is obtained by screws. Elimination of the screws in the filter according to U.S. Pat. No. 4,513,264 would destroy any possibility of operation of the filter since it would cancel coupling between the modes, thus making it impossible for the energy to propagate towards the output.

None of the above documents disclose a cavity having a nonhomogenous cross section along its axis, this being the feature allowing tuning and coupling screws to be dispensed with in the above mentioned EP-A-0 687 027 (U.S. Pat. No. 5,703,547).

A dual-mode cavity without tuning and coupling screws is also disclosed in JP-A-60 174501. Elimination of the screws is made possible by the cavity having a rectangular cross section bevelled in correspondence with a corner, or a similarly deformed elliptical cross section. The cavity has homogeneous cross section throughout its length. The structure is apparently simpler than that disclosed in EP-A-0 687 027 (U.S. Pat. No. 5,703,547), yet the cross-sectional deformation with respect to an exactly rectangular or elliptical shape results in very great numerical difficulties in analytically modelling the behaviour of the cavity itself. Thus it is very difficult to obtain the required accuracy in the design of the cavity and hence, once the cavity is manufactured, its operation will not be satisfactory.

OBJECT OF THE INVENTION

The purpose of the present invention is further to develop the solution according to EP-A-0 687 027 (U.S. Pat. No. 5,703,547), in particular with regard to the possibility of making a cavity allowing for three electromagnetic modes to resonate (so-called "triple-mode" cavity). This allows the same cavity to be used several times in making filters, with obvious benefits stemming from the reduction of the overall number of cavities and therefore of the overall size of the filter.

SUMMARY OF THE INVENTION

According to the present invention, a multi-mode cavity for waveguide filters is provided, which cavity comprises at least one waveguide arranged in eccentric position with respect to the main axis of the cavity, so as to introduce into the cavity itself a non-axial discontinuity, whereby said cavity allows for at least one additional longitudinal resonant mode to resonate.

DESCRIPTION OF THE DRAWING

The above and other objects, features, and advantages will become more readily apparent from the following description, reference being made to the accompanying drawing in which.

SPECIFIC DESCRIPTION

Figure 1:
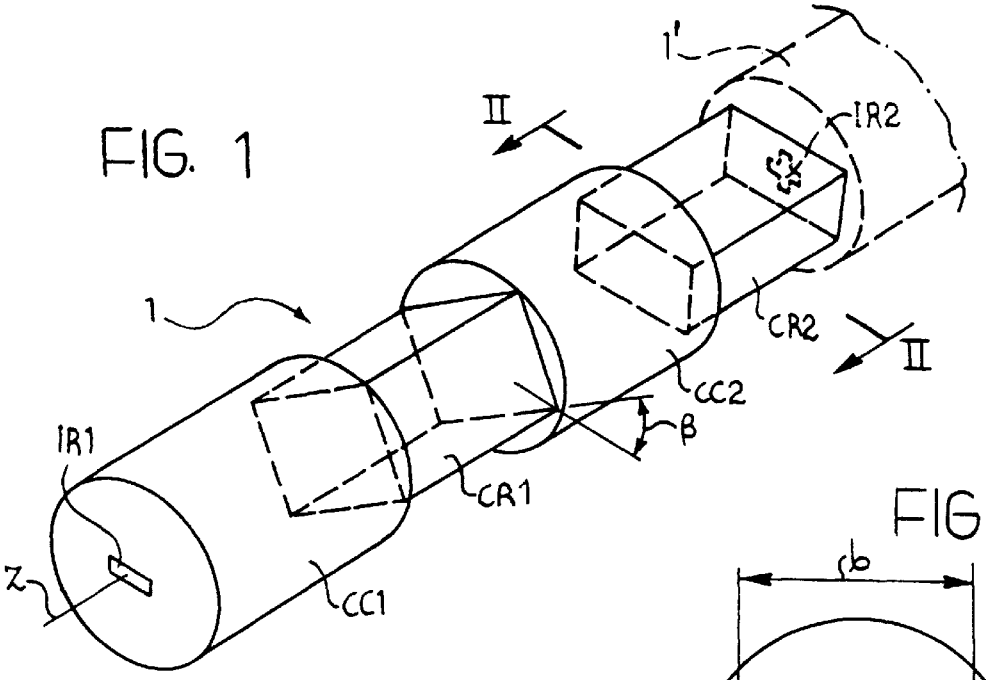
FIG. 1 is a perspective view of a cavity according to the invention.

FIG. 1 is an ideal perspective view of a cavity included in a microwave bandpass filter for use, for instance, in satellite communications.

The way the cavity is represented is wholly similar to that adopted in EP-A-0 687 027 (U.S. Pat. No. 5,703,547). As will be evident to the technician skilled in the art, such a representation shows the geometry of the volume of the cavity itself, which usually is manufactured within a body of conducting, typically metallic, material, with working processes such as turning, electrical discharge machining, etc. The related manufacture criteria are widely known to the technicians skilled in the art and do not require to be illustrated specifically herein, especially since they are not in themselves relevant for the purpose of understanding the invention.

It will also be appreciated that, for the sake of clarity, cavity 1 has been represented in the perspective views by enhancing its extension along the main longitudinal axis (axis Z) with respect to the actual construction. Differently stated, in practice, the cavity will usually be longitudinally "squashed" with respect to the shape shown. It should in any case be specified that the lengths of the individual sections of the cavity constitute design parameters for the cavity itself, as is well known.

In the exemplary embodiment depicted in FIG. 1, cavity 1 comprises four waveguide segments arranged in cascade along main axis Z.

The first three waveguide segments (starting from the left in FIG. 1) correspond essentially to the three waveguide segments forming the cavity illustrated in EP-A-0 687 027 (U.S. Pat. No. 5,703,547). They include: a first waveguide segment CC1 with circular cross section, a second waveguide segment CR1 with rectangular cross section, and a third waveguide segment CC2 again with circular cross section. The fourth waveguide segment CR2 is another segment with rectangular cross section and is arranged in cascade with the segments previously described.

IR1 indicates an iris provided at the input end of the first waveguide segment CC1. Iris IR1, whose task is to allow coupling of the modes into the cavity, is diametrically arranged with respect to the cross section of waveguide segment CC1. Its major dimension defines, with main axis Z of cavity 1, a reference plane with respect to which the sides of segment CR1 are inclined by an angle $\beta$. The criteria and the purposes of this arrangement are described in greater detail in the above mentioned EP-A-0 687 027 (U.S. Pat. No. 5,703,547). Said reference plane, indicated by $\pi$, is identified in FIGS. 2 through 4 by its intersection trace with the plane of the drawing.

IR2 indicates an iris for coupling multiple modes simultaneously, for instance a cross-shaped iris, whose horizontal element is parallel to IR1. Iris IR2 allows coupling with an additional cavity 1' arranged in cascade with cavity 1. The possible cascaded arrangement of multiple cavities such as cavity 1 described in detail herein (whether identical to or differing from each other) allows obtaining microwave filters with the desired transfer functions. Here too the manufacturing criteria are well known by the technician skilled in the art and need not be described specifically in this document.

Figure 2:
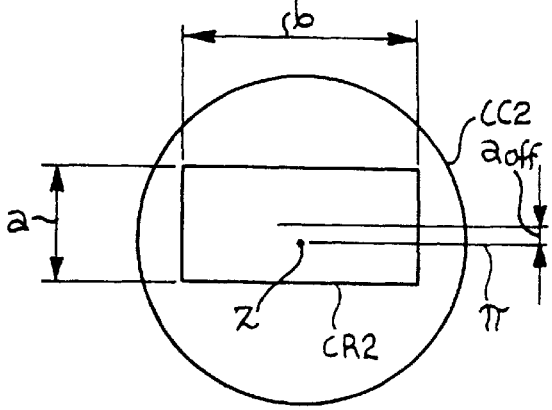
FIG. 2 is an ideal cross-sectional view taken along line 11—11 in FIG. 1.

As can be better appreciated by the cross-sectional view in FIG. 2, the characteristic of the second rectangular waveguide segment CR2 is its generally eccentric (i.e., assymmetric or off-axis) arrangement with respect to main axis Z of cavity 1 and in particular with respect to reference plane $\pi$. The amount of eccentricity (or assymmetry or spacing from the axis) defines an "offset" $a_{off}$.

In particular, in FIG. 2, offset $a_{off}$ corresponds to the distance between the main diametral plane of the cross section of waveguide segment CC2 (thus plane $\pi$) and the ideal section plane which divides in half the minor sides, of length a, of rectangular waveguide segment CR2.

The sides of rectangular waveguide segment CR2 have lengths a, b which usually, but not necessarily, differ from each other. Therefore, for the purpose of defining the scope of the invention, the term "rectangular" must be taken to include a square shape, seen as a particular case of the rectangular shape. The same applies for segment CR1.

The applicant's experiments have demonstrated that, thanks to the presence of the additional rectangular waveguide segment CR2, which defines a waveguide element introducing a non-axial discontinuity, cavity 1 depicted in FIG. 1 is able to support resonation of a TM longitudinal mode, with polarization of the electrical field directed along longitudinal axis Z of cavity 1, in addition to two transverse TE modes with polarizations respectively parallel and orthogonal to reference plane $\pi$. Thus cavity 1 behaves as a triple-mode cavity.

By operating on the amount of offset $a_{off}$ and on lengths a and b of the sides of rectangular waveguide segment CR2 (in particular on the ratio between the same, the so called "aspect ratio") it is possible independently to control the resonance frequencies of the resonant modes and the degree of coupling, so as to attain the required operating characteristics.

The embodiment depicted in FIG. 1 constitutes only one among several possible embodiments of the invention.

For example, segment CR2 may be placed along the body of the cavity, instead of constituting an end segment 1'. The end segment 1' can then be an additional segment 1' with circular cross section similar to CC1 and CC2.

Figure 3:
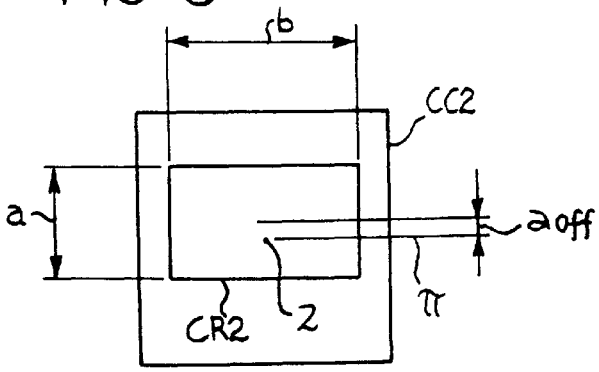
FIGS. 3 and 4 are a schematic representation, from a viewpoint essentially similar to that of FIG. 2, of two possible variant embodiments of the cavity shown in FIG. 1.

FIG. 3 shows how one or both waveguide segments CC1, CC2 with circular cross section could be replaced by waveguide segments with square or rectangular cross section, while maintaining the eccentric location of rectangular segment CR2.

Additionally, the first rectangular segment CR1 could be eliminated, so that the "non eccentric" segments of the cavity allows for a single transverse mode to resonate, and eccentric rectangular segment CR2 could be used to generate the TM longitudinal mode. This arrangement results in a dual-mode cavity propagating different modes with respect to the cavity according to EP-A-0 687 027 (U.S. Pat. No. 5,703,547).

It is also possible to merge rectangular segments CR1, CR2 into a single rectangular segment which is at the same time tilted with respect to reference plane $\pi$ and eccentric with respect to the main axis of the cavity. This solution however gives rise to some analytical difficulties in the design phase.

In addition, the eccentricity of segment CR2, which here is represented as an offset $a_{off}$ with respect to the diametral plane (defined by iris IR1) of the circular waveguide segments, could be an offset in two directions: that is, with reference to FIG. 2, CR2 would exhibit not only offset $a_{off}$, but also a corresponding offset, of identical or different amount, of the ideal median plane which divides in half the major sides b.

Figure 4:
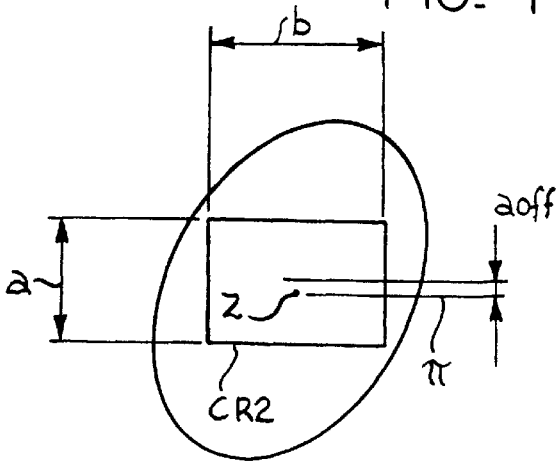

Moreover, as is depicted schematically in FIG. 4, and according to a solution constituting the subject matter of a co-pending patent application (Ser. No. 08/177,164), at least the portion of cavity comprising segments CC1 (with circular or rectangular, possibly square, cross section), CR1 (with rectangular cross section tilted by angle $\beta$) and CC2 (with circular or rectangular, possibly square cross section) could be replaced by a single waveguide segment of elliptical cross section whose axes are tilted with respect to reference plane $\pi$.

It should also be noted that, if the rectangular cross sections of segments CR1 and CR2 are larger, at least locally, than those which can be inscribed in the respective reference cross sections (circular, square, rectangular or elliptical) of the other segments in the cavity, such rectangular cross sections can be replaced by rectangular cross sections with corner portions adapted to the contour of the reference sections.

In addition, according to a variant not specifically illustrated here, eccentric waveguide segment CR2 can have circular or even elliptical cross section. The elliptical cross section could also be adopted for segment CR1.

Figure 5:
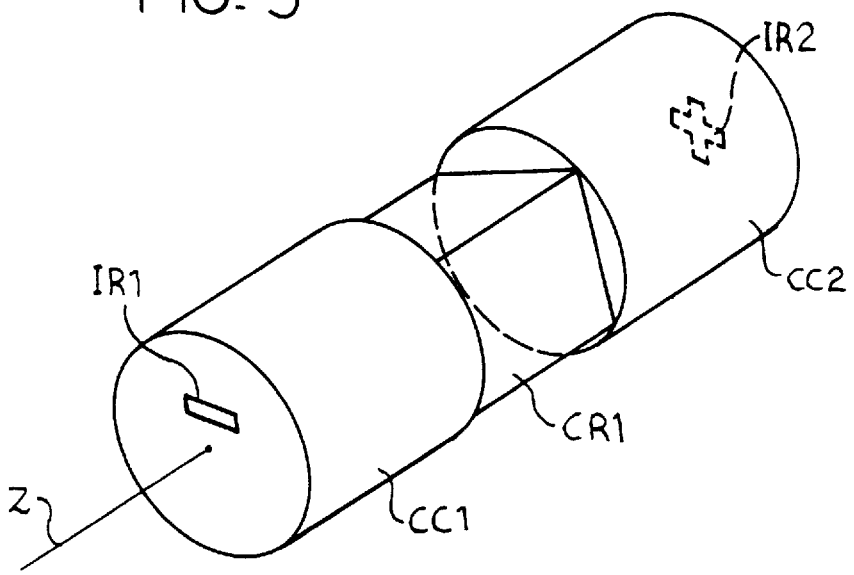
FIG. 5 depicts yet another possible variant embodiment.
Figure 6:
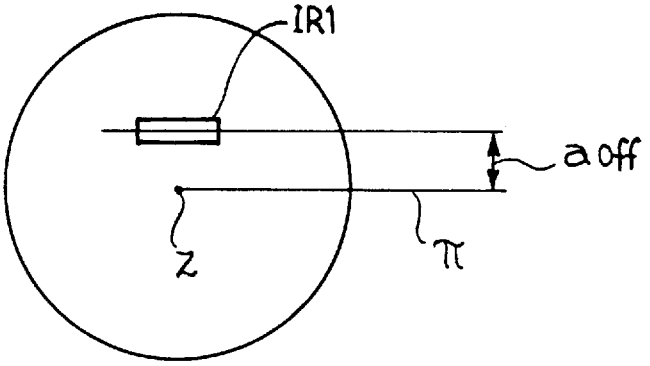
FIG. 6 is a front view of the cavity shown in FIG. 5.

Moreover, FIGS. 5 and 6—in which the same reference symbols have been used to indicate parts which are identical or functionally equivalent to those already described—shows an additional variant embodiment where the waveguide element which introduces the non-axial discontinuity, necessary for making the longitudinal mode to resonate, comprises an iris IR1 with respect to axis Z, in place of waveguide segment CR2 arranged eccentrically: that is, iris IR1 is arranged in such a way that the intersection point of its diagonals—if its shape is rectangular, as shown in the example, since other shapes, for instance elliptical, are also possible—is offset by a predetermined amount $a_{off}$ with respect to main axis Z of cavity 1, thus with respect to plane π.

Of course, all variant embodiments described above, and the various possible combinations thereof, lie within in the scope of the present invention, as is the possible loading of the cavity with a dielectric element in order to reduce the resonance frequency or the volume of the cavity.

We claim:

1. A single multi-mode cavity free from tuning screws for waveguide filters, comprising a waveguide portion configured on design for at least one resonant mode transverse with respect to a main axis of the cavity to resonate, and including at least one waveguide element arranged in an eccentric position with respect to the main axis of the cavity, so as to introduce into the cavity itself a non-axial discontinuity, whereby said at least one waveguide element allows for at least one additional longitudinal resonant mode to resonate without the tuning screws.

2. The cavity defined in claim 1 wherein said waveguide portion allows for two resonant modes to resonate, which modes are transverse with respect to said main axis of the cavity and have polarization planes orthogonal to each other, so that said additional longitudinal resonant mode constitutes a third resonant mode of the cavity.

3. The cavity defined in claim 1 wherein said at least one waveguide element arranged in eccentric position includes an iris for coupling the modes into the cavity.

4. The cavity defined in claim 1 wherein said at least one waveguide element arranged in an eccentric position comprises at least one waveguide segment.

5. The cavity defined in claim 4 wherein said at least one waveguide segment arranged in eccentric position has a rectangular cross section, with sides respectively parallel and orthogonal with respect to a reference plane defined by said main axis of the cavity and by a major transverse dimension of an iris coupling the modes into the cavity.

6. The cavity defined in claim 4 wherein said at least one waveguide segment arranged in eccentric position has a rectangular cross section, with both two pairs of sides offset with respect to said main axis of the cavity.

7. The cavity defined in claim 4, wherein said at least one waveguide segment arranged in eccentric position has circular or elliptical cross section.

8. The cavity defined in claim 6 which further comprises an additional waveguide segment with a rectangular cross section whose sides are tilted with respect to a reference plane defined by said main axis of the cavity and by a major transverse dimension of an iris coupling the modes into the cavity.

9. The cavity defined in claim 8 wherein said additional waveguide segment with a rectangular cross section is placed adjacent waveguide portion with a circular, square or rectangular cross section.

10. The cavity defined in claim 7 wherein said waveguide portion comprises a waveguide segment with elliptical cross section, able to let resonate two resonant modes transverse with respect to said main axis of the cavity, the planes of said transverse modes being orthogonal to each other.

* * * * *